US008731911B2

(12) United States Patent
Chen et al.

(10) Patent No.: US 8,731,911 B2
(45) Date of Patent: May 20, 2014

(54) HARMONICITY-BASED SINGLE-CHANNEL SPEECH QUALITY ESTIMATION

(75) Inventors: Wei-ge Chen, Sammamish, WA (US); Zhengyou Zhang, Bellevue, WA (US); Jaemo Yang, Seoul (KR)

(73) Assignee: Microsoft Corporation, Redmond, WA (US)

( * ) Notice: Subject to any disclaimer, the term of this patent is extended or adjusted under 35 U.S.C. 154(b) by 156 days.

(21) Appl. No.: 13/316,430

(22) Filed: Dec. 9, 2011

(65) Prior Publication Data

US 2013/0151244 A1 Jun. 13, 2013

(51) Int. Cl.
*G10L 21/00* (2013.01)

(52) U.S. Cl.
USPC ..... 704/205

(58) Field of Classification Search
USPC ..... 704/207, 205
See application file for complete search history.

(56) References Cited

U.S. PATENT DOCUMENTS

| | | | | |
|---|---|---|---|---|
| 7,778,825 | B2 | 8/2010 | Kim | |
| 8,311,811 | B2 * | 11/2012 | Oh et al. | 704/207 |
| 2004/0213415 | A1 | 10/2004 | Rama et al. | |
| 2008/0229206 | A1 | 9/2008 | Seymour et al. | |
| 2009/0110207 | A1 | 4/2009 | Nakatani et al. | |
| 2010/0316228 | A1 | 12/2010 | Baran et al. | |

FOREIGN PATENT DOCUMENTS

| | | | |
|---|---|---|---|
| KR | 20070099372 | A1 | 10/2007 |
| KR | 100827153 | B1 | 5/2008 |
| KR | 20100044424 | A | 4/2010 |
| WO | 2011087332 | A2 | 7/2011 |

OTHER PUBLICATIONS

Falk, et al., "Spectro-Temporal Processing for Blind Estimation of Reverberation Time and Single-Ended Quality Measurement of Reverberant Speech", Retrieved at <<http://individual.utoronto.ca/falkt/falk/pdf/FalkYuanChan_IS2007.pdf>>, 8th Annual Conference of the International Speech Communication Association, Aug. 27-31, 2007, pp. 4.

Falk, et al., "A Non-Intrusive Quality Measure of Dereverberated Speech", Retrieved at <<http://www.iwaenc.org/proceedings/2008/contents/papers/9009.pdf>>, International Workshop on Acoustic Echo and Noise Control (IWAENC), Sep. 14-17, 2008, pp. 4.

(Continued)

*Primary Examiner* — Susan McFadden
(74) *Attorney, Agent, or Firm* — Steve Wight; Carole Boelitz; Micky Minhas

(57) ABSTRACT

Speech quality estimation technique embodiments are described which generally involve estimating the human speech quality of an audio frame in a single-channel audio signal. A representation of a harmonic component of the frame is synthesized and used to compute a non-harmonic component of the frame. The synthesized harmonic component representation and the non-harmonic component are then used to compute a harmonic to non-harmonic ratio (HnHR). This HnHR is indicative of the quality of a user's speech and is designated as an estimate of the speech quality of the frame. In one implementation, the HnHR is used to establish a minimum speech quality threshold below which the quality of the user's speech is considered unacceptable. Feedback to the user is then provided based on whether the HnHR falls below the threshold.

20 Claims, 6 Drawing Sheets

(56) References Cited

OTHER PUBLICATIONS

Huang, et al., "A Blind Channel Identification-Based Two-Stage Approach to Separation and Dereverberation of Speech Signals in a Reverberant Environment", Retrieved at <<http://ieeexplore.ieee.org/stamp/stamp.jsp? tp=&arnumber=1495471>>, IEEE Transactions on Speech and Audio Processing, vol. 13, No. 5, Sep. 2005, pp. 882-895.

Tsilfidis, et al., "Blind Estimation and Suppression of Late Reverberation utilising Auditory Masking", Retrieved at <<http://ieeexplore.ieee.org/stamp/stamp.jsp?tp=&arnumber=4538723>>, Hands-Free Speech Communication and Microphone Arrays, HSCMA, May 6-8, 2008, pp. 208-211.

Nakatani, et al., "Harmonicity-Based Blind Dereverberation for Single-Channel Speech Signal", Retrieved at <<http://ieeexplore.ieee.org/stamp/stamp.jsp?arnumber=04032782>>, IEEE Transactions on Audio, Speech, and Language Processing, vol. 15, No. 1, Jan. 2007, pp. 80-95.

Habets, Emanuel Anco Peter., "Single- and Multi-Microphones Speech Dereverberation using Spectral Enhancement", Retrieved at <<http://citeseerx.ist.psu.edu/viewdoc/download? doi=10.1.1.102.1354&rep=rep1&type=pdf>>, PH.D Thesis, Jun. 25, 2007, pp. 166.

Lebart, et al., "A New Method Based on Spectral Subtraction for Speech Dereverberation", Retrieved at <<http://www.ee.columbia.edu/~dpwe/papers/LebBD01-ssdereverv.pdf>>, Acta Acustica united with Acustica, vol. 87, Jun. 2001, pp. 359-366.

Ratnam, et al., "Blind Estimation of Reverberation Time", Retrieved at <<http://murphylibrary.uwlax.edu/digital/journals/JASA/JASA2003/pdfs/vol_114/iss_5/2877_1.pdf>>, J. Acoust. Soc. Am., vol. 114, No. 5, Nov. 2003, pp. 2877-2892.

Falk, et al., "Temporal Dynamics for Blind Measurement of Room Acoustical Parameters", Retrieved at <<http://ieeexplore.ieee.org/stamp/stamp.jsp?tp=&arnumber=5422672>>, IEEE Transactions on Instrumentation and Measurement, vol. 59, No. 4, Apr. 2010, pp. 978-989.

Georfanti, et al., "Speaker Distance Detection Using a Single Microphone", Retrieved at <<http://ieeexplore.ieee.org/stamp/stamp.jsp?tp=&arnumber=5682396>>, IEEE Transactions on Audio, Speech and Language Processing, vol. 19, No. 7, Sep. 2011, pp. 1949-1961.

McAulay, et al., "Speech Analysis/Synthesis Based on a Sinusoidal Representation", Retrieved at <<http://ieeexplore.ieee.org/stamp/stamp.jsp?arnumber=01164910, IEEE Transactions on Acoustics, Speech and Signal Processing, vol. 34, No. 4, Aug. 1986, pp. 744-754.

Sun, Xuejing., "Pitch Determination and Voice Quality Analysis using Subharmonic-to-Harmonic Ratio", Retrieved at <<http://ieeexplore.ieee.org/stamp/stamp.jsp?tp=&arnumber=5743722>>, IEEE International Conference on Acoustics, Speech, and Signal Processing (ICASSP), May 13-17, 2002, pp. I-333-I-336.

Boll, Steven F., "Suppression of Acoustic Noise in Speech using Spectral Subtraction", Retrieved at <<http://ieeexplore.ieee.org/stamp/stamp.jsp?tp=&arnumber=1163209, IEEE Transactions on Acoustics, Speech and Signal Processing, vol. 27, No. 2, Aug. 1979, pp. 113-120.

Allen, et al., "Image Method for Efficiently Simulating Small Room Acoustics", Retrieved at <<http://www.umiacs.umd.edu/~ramani/cmsc828d_audio/AllenBerkley79.pdf>>, Journal of the Acoustical Society of America, vol. 65, No. 4, Apr. 1979, pp. 943-950.

Lehmann, et al., "Prediction of Energy Decay in Room Impulse Responses Simulated with an Image-Source Model", Retrieved at <<http://www.fishdsp.com/research/jasa2008.pdf>>, Journal of the Acoustical Society of America, vol. 124, No. 1, Jul. 2008, pp. 269-277.

* cited by examiner

HARMONICITY-BASED SINGLE-CHANNEL SPEECH QUALITY ESTIMATION

BACKGROUND

An acoustic signal from a distance sound source in an enclosed space produces reverberant sound that varies depending on the room impulse response (RIR). The estimation of the quality of human speech in an observed signal in light of the level of reverberation in the space provides valuable information. For example, in typical speech communication systems such as voice over Internet protocol (VOIP) systems, video conferencing systems, hands-free telephones, voice-controlled systems and hearing aids, it is advantageous to know if the speech is intelligible in the signal produced despite the room reverberation.

SUMMARY

Speech quality estimation technique embodiments described herein generally involve estimating the human speech quality of an audio frame in a single-channel audio signal. In an exemplary embodiment, a frame of the audio signal is input and the fundamental frequency of the frame is estimated. In addition, the frame is transformed from the time domain into the frequency domain. A harmonic component of the transformed frame is then computed, as well as a non-harmonic component. The harmonic and non-harmonic components are then used to compute a harmonic to non-harmonic ratio (HnHR). This HnHR is indicative of the quality of a user's speech in the single channel audio signal used to compute the ratio. As such, the HnHR is designated as an estimate of the speech quality of the frame.

In one embodiment, the estimated speech quality of the frames of the audio signal is used to provide feedback to a user. This generally involves inputting the captured audio signal and then determining whether the speech quality of the audio signal has fallen below a prescribed acceptable level. If it has, feedback is provided to the user. In one implementation, the HnHR is used to establish a minimum speech quality threshold below which the quality of the user's speech in the signal is considered unacceptable. Feedback to the user is then provided based on whether a prescribed number of consecutive audio frames have a computed HnHR that does not exceed the prescribed speech quality threshold.

It should be noted that this Summary is provided to introduce a selection of concepts, in a simplified form, that are further described below in the Detailed Description. This Summary is not intended to identify key features or essential features of the claimed subject matter, nor is it intended to be used as an aid in determining the scope of the claimed subject matter.

DESCRIPTION OF THE DRAWINGS

The specific features, aspects, and advantages of the disclosure will become better understood with regard to the following description, appended claims, and accompanying drawings where:

DETAILED DESCRIPTION

Figure 1:
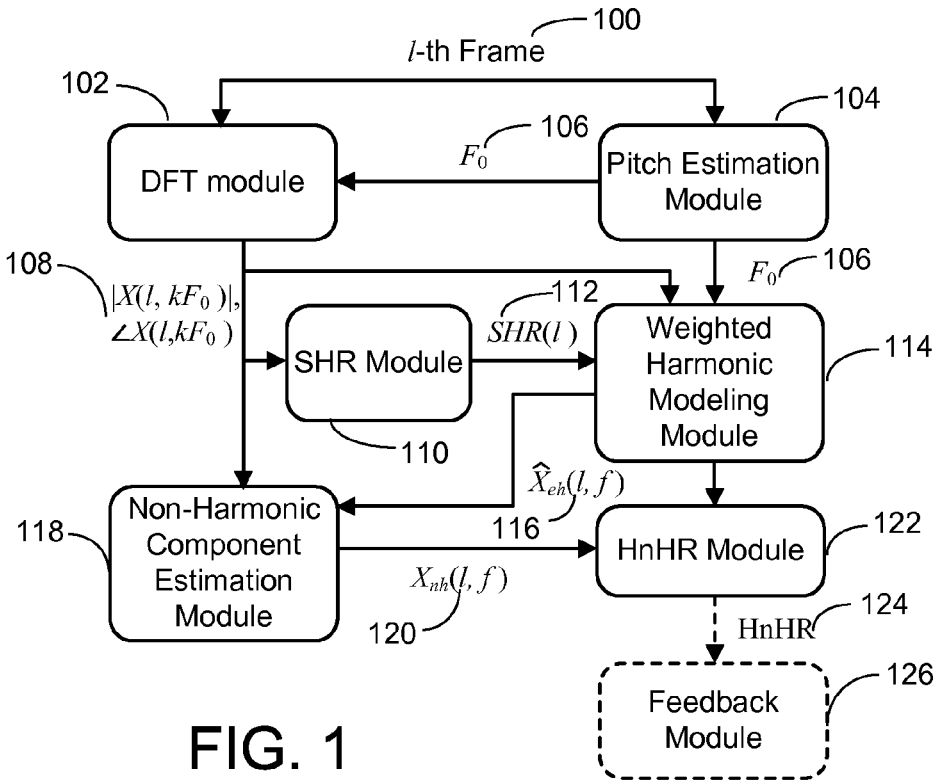
FIG. 1 is an exemplary computing program architecture for implementing speech quality estimation technique embodiments described herein.

In the following description of speech quality estimation technique embodiments reference is made to the accompanying drawings which form a part hereof, and in which are shown, by way of illustration, specific embodiments in which the technique may be practiced. It is understood that other embodiments may be utilized and structural changes may be made without departing from the scope of the technique.

1.0 Speech Quality Estimation

In general, speech quality estimation technique embodiments described herein can improve a user's experience by automatically giving feedback to the user with regard to his or her voice quality. Many factors influence the perceived voice quality such as noise level, echo leak, gain level and reverberance. Among them, the most challenging one is reverberance. Until now, there has been no known method to measure the amount of reverberance using the observed speech alone. The speech quality estimation technique embodiments described herein provide such a metric, which blindly (i.e., without the need for a "clean" signal for comparison) measures the reverberance using only observed speech samples from a signal representing a single audio channel. This has been found to be possible for random positions of speaker and sensor in various room environments, including those with reasonable amounts of background noise.

More particularly, the speech quality estimation technique embodiments described herein blindly exploit the harmonicity of an observed single-channel audio signal to estimate the quality of a user's speech. Harmonicity is a unique characteristic of human voice speech. As indicated previously, the information about the quality of the observed signal, which depends on room reverberation conditions and speaker to sensor distance, provides useful feedback to speaker. The aforementioned exploitation of the harmonicity will be described in more detail in the sections to follow.

1.1 Signal Modeling

Reverberation can be modeled by a multi-path propagation process of an acoustic sound from source to sensor in an enclosed space. Generally, the received signal can be decomposed into two components; early reverberations (and direct path sound), and late reverberations. The early reverberation, which arrives shortly after the direct sound, reinforces the sound and is a useful component to determine speech intelligibility. Due to the fact that the early reflections vary depending on the speaker and sensor positions, it also provides information on the volume of space and the distance of the speaker. The late reverberation results from reflections with longer delays after the arrival of the direct sound, which impairs speech intelligibility. These detrimental effects are generally increased with longer distance between the source and sensor.

1.1.1 Reverberant Signal Model

The room impulse response (RIR) denoted as h(n) represents the acoustical properties between sensor and speaker in a room. As indicated previously, the reverberant signal can be divided into two parts; early reverberation (including direct path) and late reverberation:

$$h(t) = \begin{cases} h_e(t) & 0 \le t < T_1 \\ h_l(t) & t \ge T_1 \\ 0 & \text{otherwise,} \end{cases} \tag{1}$$

where $h_e(t)$ and $h_l(t)$ are the early and the late reverberation of the RIR, respectively. The parameter $T_1$ can be adjusted depending on applications or subjective preference. In one implementation, $T_1$ is prescribed and ranges from 50 ms to 80 ms. The reverberant signal, x(t), obtained by the convolution of the anechoic speech signal s(n) and h(n) can be represented as:

$$x(t) = \underbrace{\int_{-\infty}^{t} s(\tau)h_e(t-\tau)d\tau}_{x_e(t)} + \underbrace{\int_{-\infty}^{t} s(\tau)h_l(t-\tau)d\tau}_{x_l(t)}. \tag{2}$$

The direct sound is received through free-field without any reflections. The early reverberation $x_e(t)$ is composed of the sounds which are reflected off one or more surfaces until $T_1$ time period. The early reverberation includes the information of the room size and the positions of speaker and sensor. The other sound resulting from reflections with long delays is the late reverberation $x_l(t)$, which impairs speech intelligibility. The late reverberation can be represented by an exponentially decaying Gaussian model. Therefore, it is reasonable assumption that the early and the late reverberation are uncorrelated.

1.1.2 Harmonic Signal Model

A speech signal can be modeled as the sum of a harmonic signal $s_h(t)$ and a non-harmonic signal $s_n(t)$ as follows:

$$s(t)=s_h(t)+s_n(t). \tag{3}$$

The harmonic part accounts for the quasi-periodic component of the speech signal (such as voice), while the non-harmonic part accounts for its non-periodic components (such as fricative or aspiration noise, and period-to-period variations caused by glottal excitations). The (quasi-) periodicity of the harmonic signal $s_h(t)$ is approximately modeled as the sum of K-sinusoidal components whose frequencies correspond to the integer multiple of the fundamental frequency $F_0$. Assuming that $A_k(t)$ and $\theta_k(t)$ are the amplitude and phase of the k-th harmonic component, it can be represented as $$s_h(t) = \sum_{k=1}^{K} A_k(t)\cos(\theta_k(t)),\ \dot{\theta}_k(t) = k\dot{\theta}_1(t), \tag{4}$$

where $\dot{\theta}_k(t)$ is the time derivative of the phase of the k-th harmonic component and $\dot{\theta}_1(t)$ is the $F_0$. Without loss of generality, $A_k(t)$ and $\theta_k(t)$ can be derived from the short time Fourier transform (STFT) of the signal S(f) around time index $n_0$ which are given as $$A_k(t) = |S(k\dot{\theta}_1(n_0))|, \tag{5}$$

$$\theta_k(t) = \angle S(k\dot{\theta}_1(n_0)) + \frac{2\pi\gamma[k\dot{\theta}_1(n_0)]}{\Gamma},$$

where $\Gamma=2\gamma+1$ is a short enough analysis window that it extracts the time-varying feature of the harmonic signal.

1.2 Harmonic to Non-Harmonic Ratio Estimation

Given the foregoing signal model, one implementation of the speech quality estimation technique involves a single-channel speech quality estimation approach, which uses the ratio between the harmonic and the non-harmonic components of the observed signal. After defining the harmonic to non-harmonic ratio (HnHR), it will be shown that the ideal HnHR corresponds to the standard room acoustical parameter.

1.2.1 Room Acoustic Parameters

The ISO 3382 standard defines several room acoustical parameters and specifies how to measure the parameters using known room impulse response (RIR). Among these parameters, the speech quality estimation technique embodiments described herein advantageously employ the reverberation time (T60) and clarity (C50, C80) parameters, in part because they can represent not only the room condition but also the speaker to sensor distance. The reverberation time (T60) is defined as a time interval required for the sound energy to decay 60 dB after the excitation has stopped. It is closely related to room volume and quantity of the whole reverberation. However, the speech quality can also vary by the distance between a sensor and speaker, even if it is measured in a same room. The clarity parameters are defined as the logarithmic energy ratio of an impulse response between early and late reverberation given as follows:

$$C_{\#} = 10\log\left(\frac{\int_0^{\#} h_2(t)\,dt}{\int_{\#}^{\infty} h^2(t)\,dt}\right)[dB], \tag{6}$$

where in one embodiment C# refers to C50 and is used to express the clarity of speech. It is noted that C80 is better suited for music and would be used in embodiments involving music clarity. It is further noted that if # is very small (e.g., smaller than 4 milliseconds), the clarity parameter becomes a good approximation of the direct-to-reverberant energy ratio (DRR), which gives the information of the distance from speaker to sensor. Actually, the clarity index is closely related to the distance.

1.2.2 Reverberant Signal Harmonic Component

In a practical system, h(n) is unknown and it is very hard to blindly estimate an accurate RIR. However, the ratio between the harmonic and the non-harmonic component of the observed signal provides useful information on speech quality. Using Eqs. (1), (2) and (3), the observed signal x(t) can be decomposed into the following harmonic $x_{eh}(t)$ and non-harmonic $x_{nh}(t)$ components:

$$x(t) = (h_e(t) + h_l(t)) * (s_h(t) + s_n(t)) \tag{7}$$

$$= \underbrace{h_e(t) * s_h(t)}_{x_{eh}(t)} + \underbrace{\underbrace{h_l(t) * s_h(t)}_{x_{lh}(t)} + \underbrace{h(t) * s_n(t)}_{x_n(t)}}_{x_{nh}(t)},$$

where * represents the convolution operation. $x_{eh}(t)$ is the early reverberation of the harmonic signal which is composed of the sum of several reflections with small delays. Since the length of the $h_e(t)$ is essentially short, $x_{eh}(t)$ can be seen as a harmonic signal in low frequency band. Therefore, it is possible to model $x_{eh}(t)$ as a harmonic signal similar to Eq. (4). $x_{lh}(t)$ and $x_n(t)$ are the late reverberation of the harmonic signal and reverberation of noisy signal $s_n(t)$, respectively.

1.2.3 Harmonic to Non-Harmonic Ratio (HnHR)

The early-to-late signal ratio (ELR) can be regarded as one of the room acoustical parameters relating to speech clarity. Ideally, if it is assumed that h(t) and s(t) are independent, ELR can be represented as follows:

$$ELR = \frac{E\{|X_e(f)|^2\}}{E\{|X_l(f)|^2\}} \approx \frac{E\{|H_e(f)|^2\}}{E\{|H_l(f)|^2\}}, \tag{8}$$

where E{ } represents the expectation operator. Actually, Eq. (8) becomes C50 (when T (as in Eq. (2)) is 50 ms), while $x_e(t)$ and $x_l(t)$ are practically unknown. From to Eq. (2) and Eq. (7), it is possible to assume that $x_{eh}(t)$ and $x_{nh}(t)$ follow $x_e(t)$ and $x_l(t)$, respectively, because $s_n(t)$ has much smaller energy than $s_h(t)$ when the signal-to-noise ratio (SNR) is reasonable. Therefore, the harmonic to non-harmonic ratio (HnHR) given in Eq. (9) can be regarded as the replacement for the ELR value:

$$HnHR = \frac{E\{|X_{eh}(f)|^2\}}{E\{|X_{nh}(f)|^2\}}. \tag{9}$$

1.2.4 HnHR Estimation Technique

An exemplary computing program architecture for implementing the speech quality estimation technique embodiments described herein is shown in FIG. 1. This architecture includes various program modules executable by a computing device (such as one described in the exemplary operating environment section to follow).

1.2.4.1 Discrete Fourier Transform and Pitch Estimation

More particularly, each frame l 100 of the reverberant signal $\bar{x}(l)$ is first fed into a discrete Fourier transform (DFT) module 102 and a pitch estimation module 104. In one implementation, the frame length is set to 32 milliseconds with a 10 millisecond sliding Hanning window. The pitch estimation module 104 estimates the fundamental frequency $F_0$ 106 of the frame 100, and provides the estimate to the DFT module 102. $F_0$ can be computed using any appropriate method.

The DFT module 102 transforms the frame 100 from the time domain into the frequency domain, and then outputs the magnitude and phase ($|X(l, kF_0)|$, $\angle X(l, kF_0)$ 108) of the frequencies in the resulting frequency spectrum corresponding to each of a prescribed number of integer multiples k of the fundamental frequency $F_0$ 106 (i.e., harmonic frequencies). It is noted that in one implementation, the size of the DFT is four times longer than the frame length.

1.2.4.2 Subharmonic-to-Harmonic Ratio

The magnitude and phase values 108 are input into a subharmonic-to-harmonic ratio (SHR) module 110. The SHR uses these values to compute a subharmonic-to-harmonic ratio SHR(l) 112 for the frame under consideration. In one implementation, this is accomplished using Eq. (10) as follows:

$$SHR(l) = \frac{\Sigma_k |X(l, kF_0)|}{\Sigma_k |X(l, (k-0.5)F_0)|}. \tag{10}$$

where k is an integer number and ranges between values that keep the product of k and the fundamental frequency $F_0$ 106 between a prescribed frequency range. In one implementation, the prescribed frequency range is 50-5000 Hertz. This calculation has been found to provide a robust performance in noisy and reverberant environments. It is noted that the higher frequency band is disregarded because the harmonicity is relatively low and the estimated harmonic frequency can be erroneous compared to the low frequency band.

1.2.4.3 Weighted Harmonic Component Modeling

Figure 2:
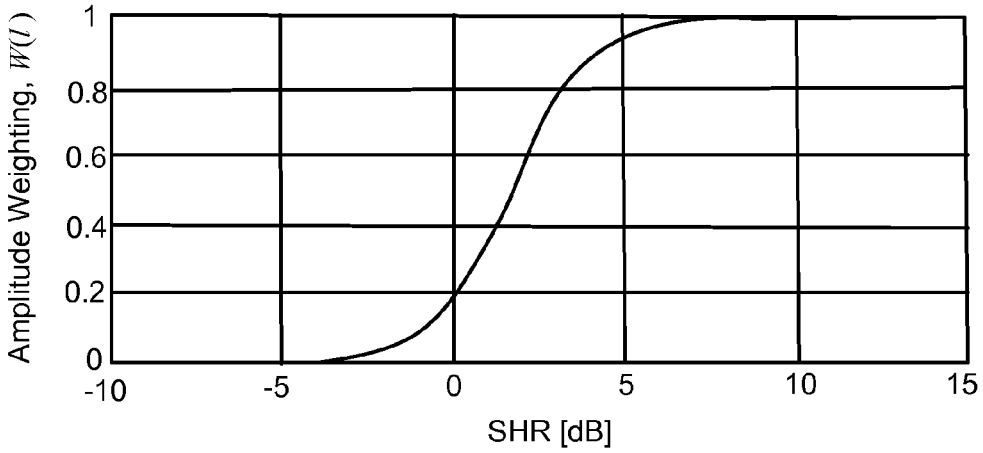
FIG. 2 is a graph of an exemplary frame-based amplitude weighting factor that gradually decreases the energy of a synthesized harmonic component signal at the reverberation tail interval.

The subharmonic-to-harmonic ratio SHR(l) 112 for the frame under consideration is provided, along with the fundamental frequency $F_0$ 106 and the magnitude and phase values 108, to a weighted harmonic modeling module 114. The weighted harmonic modeling module 114 uses the estimated $F_0$ 106 and the amplitude and phase at each harmonic frequency, to synthesize the harmonic component $x_{eh}(t)$ in the time domain, as will be described shortly. However, first it is noted that the harmonicity the reverberation tail interval of the input frame gradually decreases after the speech offset instant and could be disregarded. For example, a voice activity detection (VAD) technique can be employed to identify which of the amplitude values produced by the DFT module fall below a prescribed cut-off threshold. If an amplitude value falls below the cut-off threshold, it is eliminated for the frame being processed. The cut-off threshold is set so that the harmonic frequencies associated with the reverberation tail will typically fall below the threshold, thereby elimination the tail harmonics. However, it is further noted that the reverberation tail interval affects the aforementioned HnHR because a large portion of the late reverberation components are included in this interval. Therefore, instead of eliminating all the tail harmonics, in one implementation, a frame-based amplitude weighting factor is applied to gradually decrease the energy of the synthesized harmonic component signal in the reverberation tail interval. In one implementation, this factor is computed as follows:

$$W(l) = \frac{SHR(l)^4}{SHR(l)^4 + \varepsilon}, \tag{11}$$

where $\epsilon$ is a weighting parameter. In tested embodiments it was found that setting $\epsilon$ to 5 produced satisfactory results, although other values can be used instead. The foregoing weighting function is graphed in FIG. 2. As can be seen, the original harmonic model is maintained when SHR is larger than 7 dB (as W(l)=1.0), and the amplitude of the harmonically modeled signal will gradually decrease when the SHR is smaller than 7 dB.

Given the foregoing, the time domain harmonic component $x_{eh}(t)$ is synthesized for a series of sample times with reference to Eq. (4) and using the weighting factor W(l), as follows:

$$\hat{x}_{eh}(l, t) = W(l)\sum_{k=1}^{K} |X(l, kF_0)|\cos(\angle S(kF_0) + 2\pi kF_0 t) \tag{12}$$

where $\hat{x}_{eh}(l,t)$ is the synthesized time domain harmonic component for the frame under consideration. It is noted that in one implementation a sampling frequency of 16 kilohertz was employed to produce $\hat{x}_{eh}(l,t)$ at the series of sample times t. The synthesized time domain harmonic component for the frame is then transformed into the frequency domain for further processing. To this end:

$$\hat{x}_{eh}(l,f) = DFT(\hat{x}_{eh}(l,t)) \tag{13}$$

where $\hat{X}_{eh}(l,f)$ is the synthesized frequency domain harmonic component for the frame under consideration.

1.2.4.4 Non-Harmonic Component Estimation

The magnitude and phase values 108 are also provided, along with the synthesized frequency domain harmonic component $\hat{X}_{eh}(l,f)$ 116 to a non-harmonic component estimation module 118. The non-harmonic component estimation module 118 uses the amplitude and phase at each harmonic frequency and synthesized frequency domain harmonic component $\hat{X}_{eh}(l,f)$ 116, to compute a frequency domain non-harmonic component $X_{nh}(l,f)$ 120. Without loss of generality, it can be assumed that the harmonic and non-harmonic signal components are uncorrelated. Therefore, the spectral variance of the non-harmonic part can be derived, in one implementation, from a spectral subtraction method as follows:

$$E\{|X_{nh}(l,f)|^2\}=E\{|X(l,f)-\hat{X}_{eh}(l,f)|^2\}. \tag{14}$$

1.2.4.5 Harmonic to Non-Harmonic Ratio

The synthesized frequency domain harmonic component $|\hat{X}_{eh}(l,f)|$ 118 and the frequency domain non-harmonic component $|X_{nh}(l,f)|$ 120 are provided to a HnHR module 122. The HnHR module 122 estimates the HnHR 124 using the concept of Eq. (9). More particularly, the HnHR 124 for a frame is computed as follows:

$$HnHR=\frac{E\{|\hat{X}_{eh}(l,f)|^2\}}{E\{|X_{nh}(l,f)|^2\}}. \tag{15}$$

In one implementation, Eq. 15 is simplified to $$HnHR=\frac{\Sigma_f|\hat{X}_{eh}(l,f)|^2}{\Sigma_f|X_{nh}(l,f)|^2}, \tag{16}$$

where f refers to frequencies in the frequency spectrum of the frame corresponding to each of the prescribed number of integer multiples of the fundamental frequency.

It is noted that rather than viewing the signal frames in isolation, the HnHR 124 can be smoothed in view of one or more preceding frames. For example, in one implementation, the smoothed HnHR is calculated using a first order recursive averaging technique with a forgetting factor of 0.95:

$$HnHR=\frac{E\{|\hat{X}_{eh}(l,f)|^2\}+0.95E\{|\hat{X}_{eh}(l-1,f)|^2\}}{E\{|X_{nh}(l,f)|^2\}+0.95E\{|X_{nh}(l-1,f)|^2\}} \tag{17}$$

In one implementation, Eq. 17 is simplified to $$HnHR=\frac{\Sigma_f|\hat{X}_{eh}(l,f)|^2+0.95\Sigma_f|\hat{X}_{eh}(l-1,f)|^2}{\Sigma_f|X_{nh}(l,f)|^2+0.95\Sigma_f|X_{nh}(l-1,f)|^2} \tag{18}$$

1.2.4.6 Exemplary Process

The foregoing computing program architecture can be advantageously used to implement the speech quality estimation technique embodiments described herein. In general, estimating speech quality of an audio frame in a single-channel audio signal involves transforming the frame from the time domain into the frequency domain, and then computing harmonic and non-harmonic components of the transformed frame. A harmonic to non-harmonic ratio (HnHR) is then computed, which represents an estimate of the speech quality of the frame.

Figure 3:
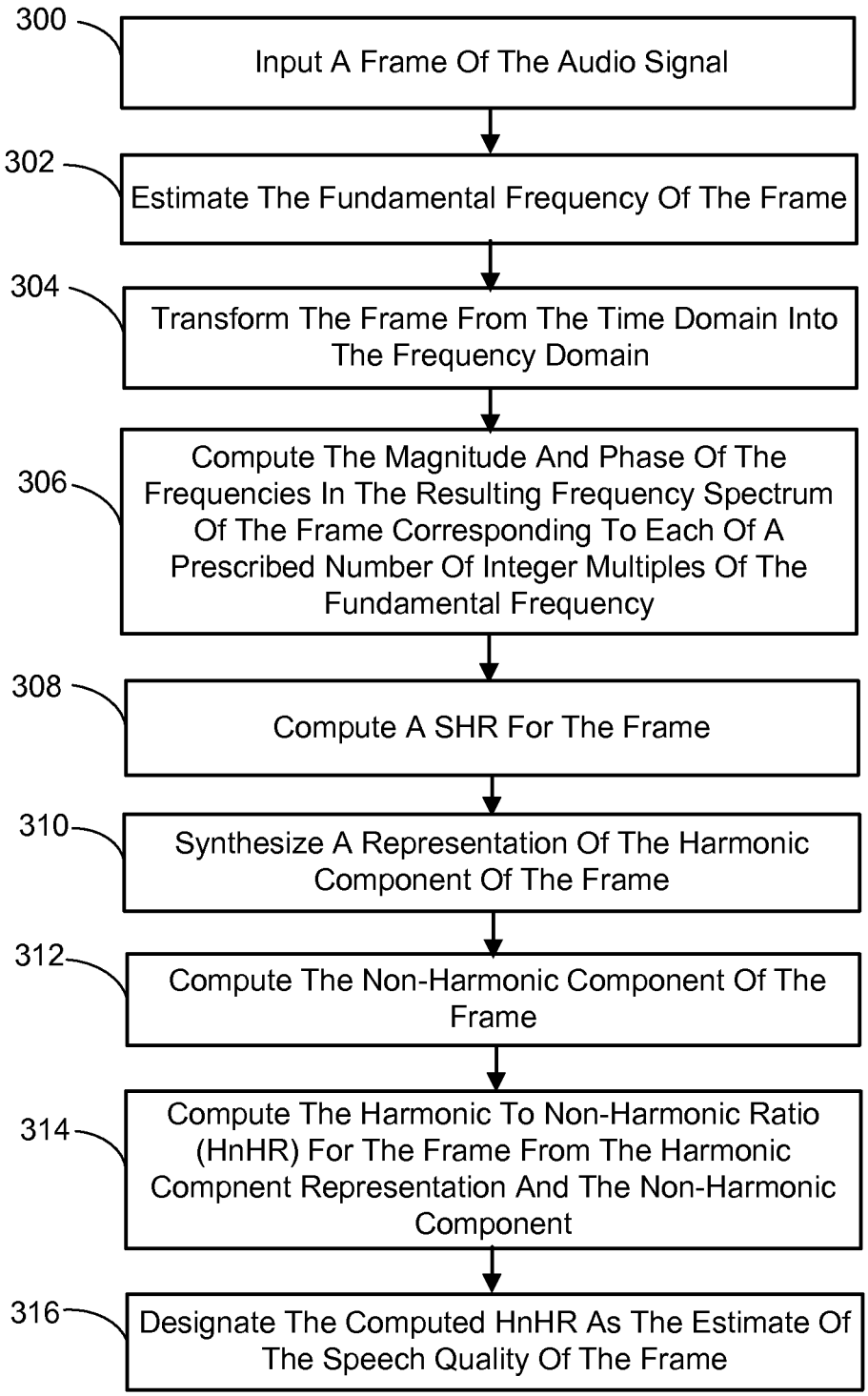
FIG. 3 is a flow diagram generally outlining one embodiment of a process for estimating speech quality of a frame of a reverberant signal.

More particularly, with reference to FIG. 3, one implementation of a process for estimating speech quality of a frame of a reverberant signal is presented. The process begins with inputting a frame of the signal (process action 300), and estimating the fundamental frequency of the frame (process action 302). The inputted frame is also transformed from the time domain into the frequency domain (process action 304). The magnitude and phase of the frequencies in the resulting frequency spectrum of the frame corresponding to each of a prescribed number of integer multiples of the fundamental frequency (i.e., the harmonic frequencies) are then computed (process action 306). Next, the magnitude and phase values are used to compute a subharmonic-to-harmonic ratio (SHR) for the input frame (process action 308). The SHR, along with the fundamental frequency and the magnitude and phase values, are then used to synthesize a representation of the harmonic component of the reverberant signal frame (process action 310). Given the aforementioned the magnitude and phase values and the synthesized harmonic component, in process action 312, the non-harmonic component of the reverberant signal frame is then computed (for example by using a spectral subtraction technique). The harmonic and non-harmonic components are then used to compute a harmonic to non-harmonic ratio (HnHR) (process action 314). As indicated previously, the HnHR is indicative of the speech quality of the input frame. Accordingly, the computed HnHR is designated as the estimate of the speech quality of the frame (process action 316).

1.3 Feedback to the User

As described previously, the HnHR is indicative of the quality of a user's speech in the single channel audio signal used to compute the ratio. This provides an opportunity to use the HnHR to establish a minimum speech quality threshold below which the quality of the user's speech in the signal is considered unacceptable. The actual threshold value will depend on the application, as some applications will require a higher quality than others. As the threshold value can be readily established for an application without undue experimentation, it establishment will not be described in detail herein. However, it is noted that in one tested implementation involving noise free conditions, the minimum speech quality threshold value was subjectively set to 10 dB with acceptable results.

Given a minimum speech quality threshold value, feedback can be provided to the user that the speech quality of the captured audio signal has fallen below an acceptable level whenever a prescribed number of consecutive audio frames have a computed HnHR that does not exceed the threshold value. This feedback can be in any appropriate form—for example, it could be visual, audible, haptic, and so on. The feedback can also include instruction to the user for improving the speech quality of the captured audio signal. For example, in one implementation, the feedback can involve requesting that the user move closer to the audio capturing device.

1.3.1 Exemplary User Feedback Process

Figure 4:
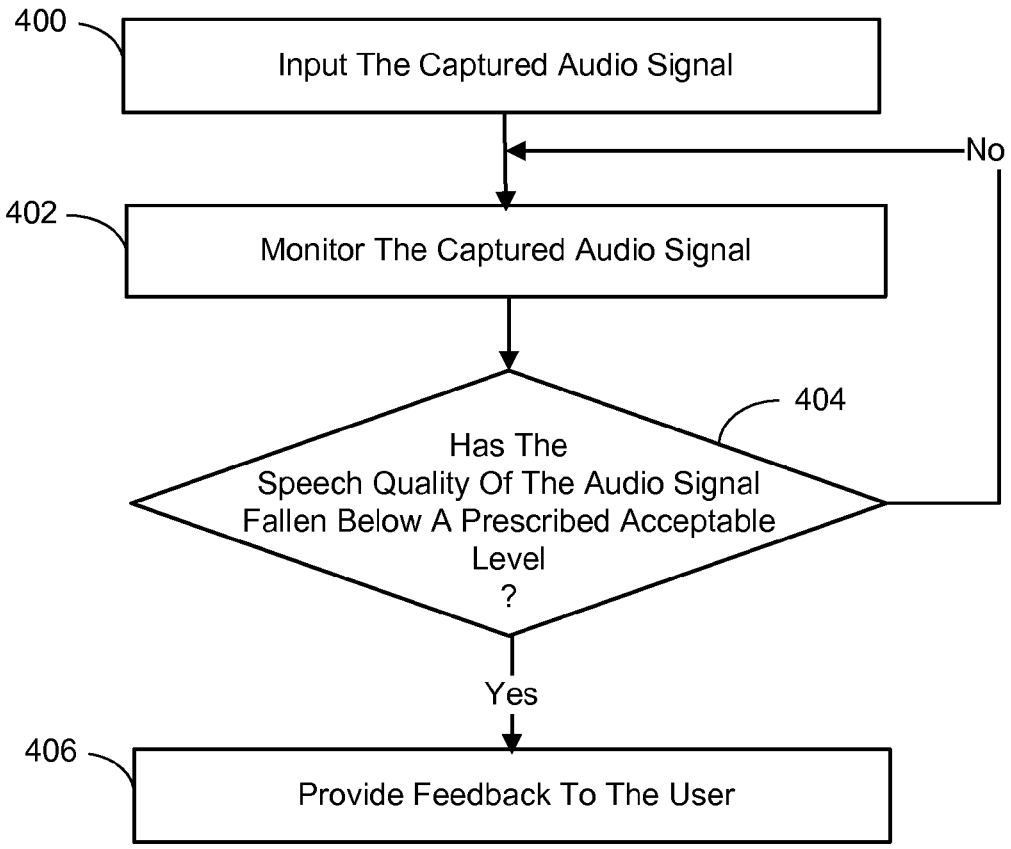
FIG. 4 is a flow diagram generally outlining one embodiment of a process for providing feedback to a user of an audio speech capturing system about the quality of human speech in a captured single-channel audio signal.

With the optional addition of a feedback module 126 (shown as a broken line box to indicate its optional nature), the foregoing computing program architecture of FIG. 1 can be advantageously used to provide feedback to a user on whether the quality of his or her speech in the captured audio signal has fallen below a prescribed threshold. More particularly, with reference to FIG. 4, one implementation of a process for providing feedback to a user of an audio speech capturing system about the quality of human speech in a captured single-channel audio signal is presented.

The process begins with inputting the captured audio signal (process action 400). The captured audio signal is monitored (process action 402), and it is periodically determined whether the speech quality of the audio signal has fallen below a prescribed acceptable level (process action 404). If not, process actions 402 and 404 are repeated. If, however, it is determined that the speech quality of the audio signal has fallen below the prescribed acceptable level, then feedback is provided to the user (process action 406).

Figure 5A:
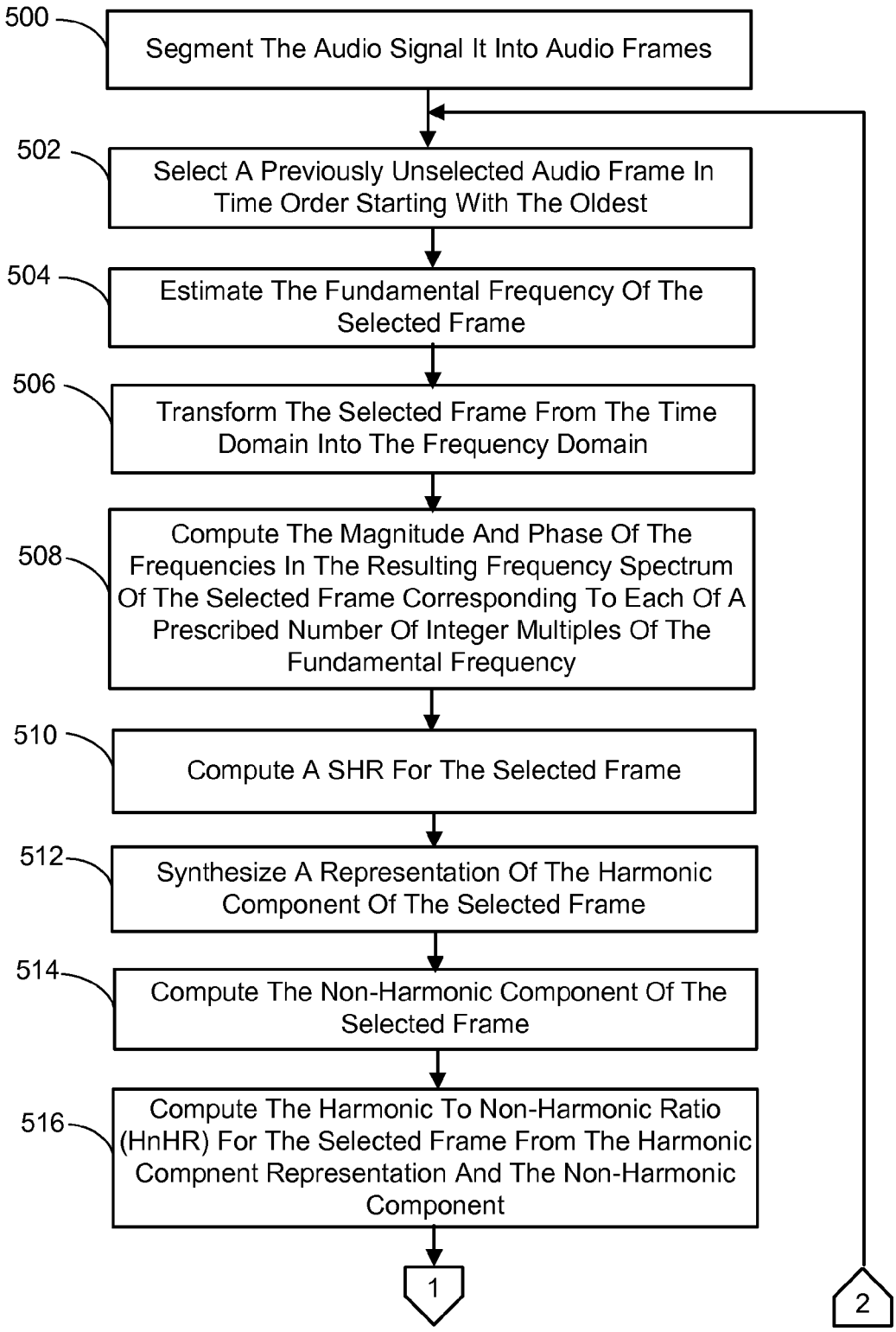
FIGS. 5A-B are a flow diagram generally outlining one implementation of a process action of FIG. 4 for determining whether the speech quality of the audio signal has fallen below the prescribed level.
Figure 5B:
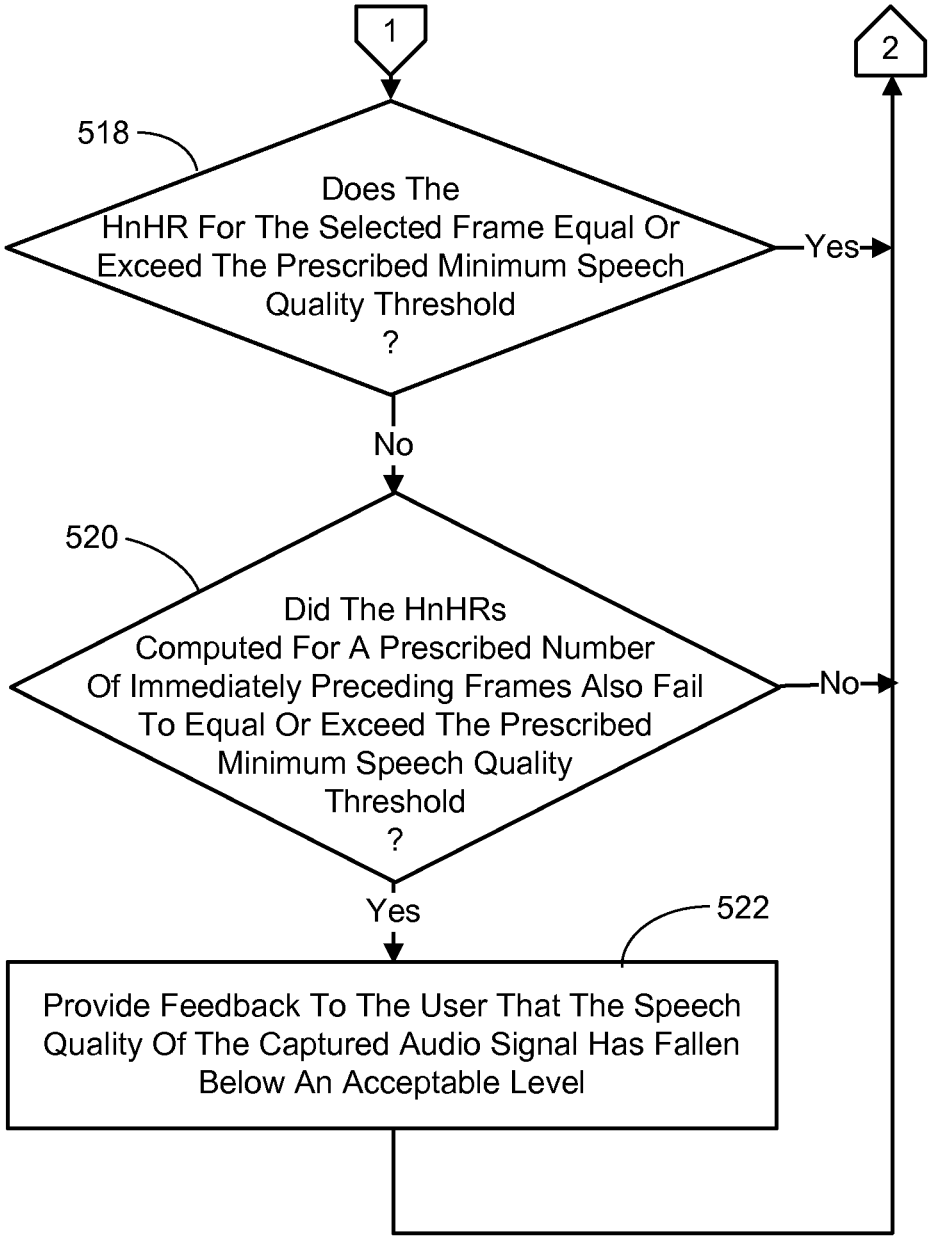

The action of determining whether the speech quality of the audio signal has fallen below the prescribed level is accomplished in much the same way as described in connection with FIG. 3. More particularly, referring to FIGS. 5A-B, one implementation of such a process involves first segmenting it into audio frames (process action 500). It is noted that the audio signal can be input as it is being captured in a real time implementation of this exemplary process. A previously unselected audio frame is selected in time order starting with the oldest (process action 502). It is noted that the frames can be segmented in time order and selected as they are produced in the real time implementation of the process.

Next, the fundamental frequency of the selected frame is estimated (process action 504). The selected frame is also transformed from the time domain into the frequency domain to produce a frequency spectrum of the frame (process action 506). The magnitude and phase of the frequencies in the frequency spectrum of the selected frame corresponding to each of a prescribed number of integer multiples of the fundamental frequency (i.e., the harmonic frequencies) are then computed (process action 508).

Next, the magnitude and phase values are used to compute a subharmonic-to-harmonic ratio (SHR) for the selected frame (process action 510). The SHR, along with the fundamental frequency and the magnitude and phase values, are then used to synthesize a representation of the harmonic component of the selected frame (process action 512). Given the aforementioned the magnitude and phase values and the synthesized harmonic component, the non-harmonic component of the selected frame is then computed (process action 514). The harmonic and non-harmonic components are then used to compute a harmonic to non-harmonic ratio (HnHR) for the selected frame (process action 516).

It is next determined if the HnHR computed for the selected frame equals or exceeds a prescribed minimum speech quality threshold (process action 518). If it does, then process action 502 through 518 are repeated. If it does not, then in process action 520 it is determined whether the HnHRs computed for a prescribed number of immediately preceding frames also failed to equal or exceed the prescribed minimum speech quality threshold (e.g., 30 preceding frames). If not, process actions 502 through 520 are repeated. If, however, the HnHRs computed for the prescribed number of immediately preceding frames did fail to equal or exceed the prescribed minimum speech quality threshold, then it is deemed that the speech quality of the audio signal has fallen below the prescribed acceptance level, and feedback is provided to the user to that effect (process action 522). Process actions 502 through 522 are then repeated as appropriate for as long as the process is active.

2.0 Exemplary Operating Environments

Figure 6:
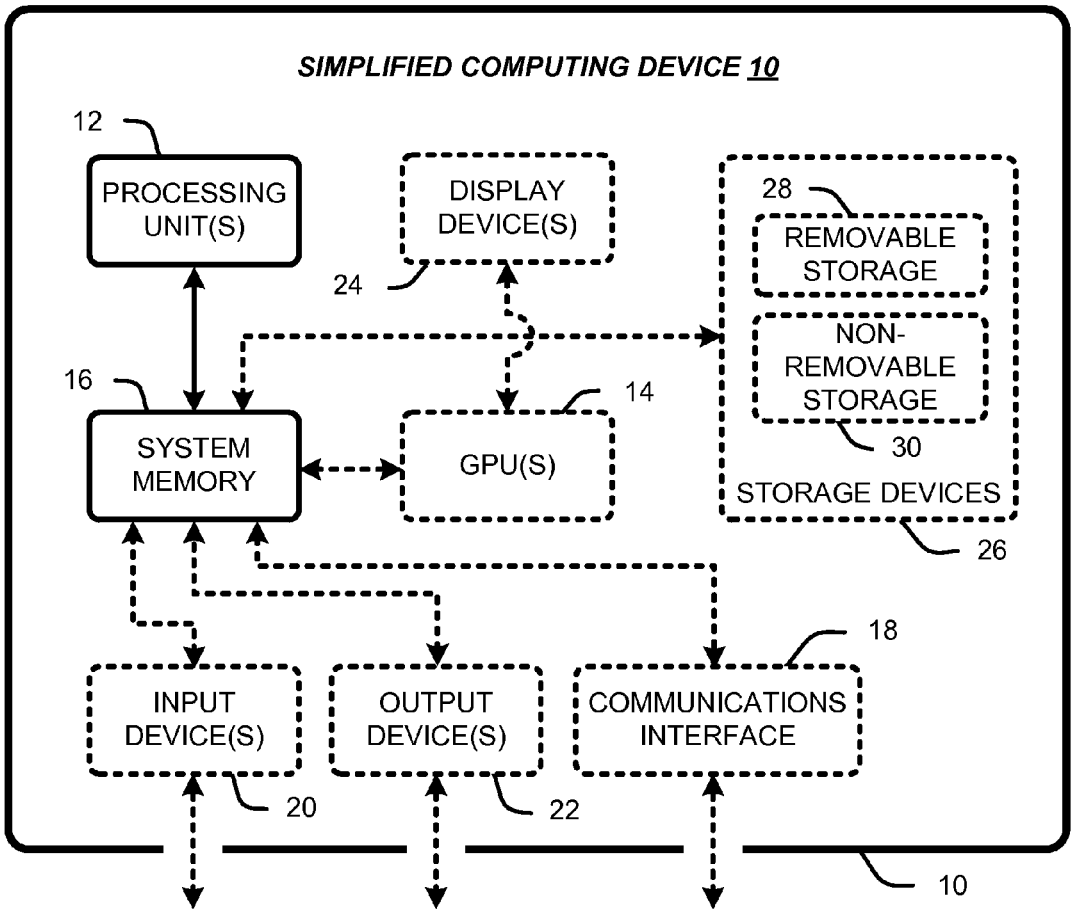
FIG. 6 is a diagram depicting a general purpose computing device constituting an exemplary system for implementing speech quality estimation technique embodiments described herein.

The speech quality estimation technique embodiments described herein are operational within numerous types of general purpose or special purpose computing system environments or configurations. FIG. 6 illustrates a simplified example of a general-purpose computer system on which various embodiments and elements of the speech quality estimation technique embodiments, as described herein, may be implemented. It should be noted that any boxes that are represented by broken or dashed lines in FIG. 6 represent alternate embodiments of the simplified computing device, and that any or all of these alternate embodiments, as described below, may be used in combination with other alternate embodiments that are described throughout this document.

For example, FIG. 6 shows a general system diagram showing a simplified computing device 10. Such computing devices can be typically be found in devices having at least some minimum computational capability, including, but not limited to, personal computers, server computers, hand-held computing devices, laptop or mobile computers, communications devices such as cell phones and PDA's, multiprocessor systems, microprocessor-based systems, set top boxes, programmable consumer electronics, network PCs, minicomputers, mainframe computers, audio or video media players, etc.

To allow a device to implement the speech quality estimation technique embodiments described herein, the device should have a sufficient computational capability and system memory to enable basic computational operations. In particular, as illustrated by FIG. 6, the computational capability is generally illustrated by one or more processing unit(s) 12, and may also include one or more GPUs 14, either or both in communication with system memory 16. Note that that the processing unit(s) 12 of the general computing device may be specialized microprocessors, such as a DSP, a VLIW, or other micro-controller, or can be conventional CPUs having one or more processing cores, including specialized GPU-based cores in a multi-core CPU.

In addition, the simplified computing device of FIG. 6 may also include other components, such as, for example, a communications interface 18. The simplified computing device of FIG. 6 may also include one or more conventional computer input devices 20 (e.g., pointing devices, keyboards, audio input devices, video input devices, haptic input devices, devices for receiving wired or wireless data transmissions, etc.). The simplified computing device of FIG. 6 may also include other optional components, such as, for example, one or more conventional display device(s) 24 and other computer output devices 22 (e.g., audio output devices, video output devices, devices for transmitting wired or wireless data transmissions, etc.). Note that typical communications interfaces 18, input devices 20, output devices 22, and storage devices 26 for general-purpose computers are well known to those skilled in the art, and will not be described in detail herein.

The simplified computing device of FIG. 6 may also include a variety of computer readable media. Computer readable media can be any available media that can be accessed by computer 10 via storage devices 26 and includes both volatile and nonvolatile media that is either removable 28 and/or non-removable 30, for storage of information such as computer-readable or computer-executable instructions, data structures, program modules, or other data. By way of example, and not limitation, computer readable media may comprise computer storage media and communication media. Computer storage media includes, but is not limited to, computer or machine readable media or storage devices such as DVD's, CD's, floppy disks, tape drives, hard drives, optical drives, solid state memory devices, RAM, ROM, EEPROM, flash memory or other memory technology, magnetic cassettes, magnetic tapes, magnetic disk storage, or other magnetic storage devices, or any other device which can be used to store the desired information and which can be accessed by one or more computing devices.

Retention of information such as computer-readable or computer-executable instructions, data structures, program modules, etc., can also be accomplished by using any of a variety of the aforementioned communication media to encode one or more modulated data signals or carrier waves, or other transport mechanisms or communications protocols, and includes any wired or wireless information delivery mechanism. Note that the terms "modulated data signal" or "carrier wave" generally refer to a signal that has one or more of its characteristics set or changed in such a manner as to encode information in the signal. For example, communication media includes wired media such as a wired network or direct-wired connection carrying one or more modulated data signals, and wireless media such as acoustic, RF, infrared, laser, and other wireless media for transmitting and/or receiving one or more modulated data signals or carrier waves. Combinations of the any of the above should also be included within the scope of communication media.

Further, software, programs, and/or computer program products embodying some or all of the various speech quality estimation technique embodiments described herein, or portions thereof, may be stored, received, transmitted, or read from any desired combination of computer or machine readable media or storage devices and communication media in the form of computer executable instructions or other data structures.

Finally, the speech quality estimation technique embodiments described herein may be further described in the general context of computer-executable instructions, such as program modules, being executed by a computing device. Generally, program modules include routines, programs, objects, components, data structures, etc., that perform particular tasks or implement particular abstract data types. The embodiments described herein may also be practiced in distributed computing environments where tasks are performed by one or more remote processing devices, or within a cloud of one or more devices, that are linked through one or more communications networks. In a distributed computing environment, program modules may be located in both local and remote computer storage media including media storage devices. Still further, the aforementioned instructions may be implemented, in part or in whole, as hardware logic circuits, which may or may not include a processor.

3.0 Other Embodiments

While the speech quality estimation technique embodiments described so far processed each frame derived from the captured audio signal, this need not be the case. In one embodiment, before each audio frame is processed, a VAD technique can be employed to determine whether the power of the signal associated with the frame is less than a prescribed minimum power threshold. If the frame's signal power is less than the prescribed minimum power threshold, it is deemed that the frame has no voice activity and it is eliminated from further processing. This can result in reduced processing cost and faster processing. It is noted that the prescribed minimum power threshold is set so that most of the harmonic frequencies associated with the reverberation tail will typically exceed the threshold, thereby preserving the tail harmonics for the reasons described previously. In one implementation, the prescribed minimum power threshold is set to 3% of the average signal power.

It is noted that any or all of the aforementioned embodiments throughout the description may be used in any combination desired to form additional hybrid embodiments. In addition, although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

Wherefore, what is claimed is:

1. A computer-implemented process for estimating speech quality of an audio frame in a single-channel audio signal comprising human speech components, comprising:

using a computer comprising a processing unit and a memory to perform the following process actions:

inputting a frame of the audio signal;

transforming the inputted frame from the time domain into the frequency domain;

computing a harmonic component of the transformed frame;

computing a non-harmonic component of the transformed frame;

computing a harmonic to non-harmonic ratio (HnHR); and designating the computed HnHR as an estimate of the speech quality of the inputted frame in the single-channel audio signal.

2. A computer-implemented process for estimating, speech quality of an audio frame in a single-channel audio signal comprising human speech components, comprising:

using a computer comprising a processing unit and a memory to perform the following process actions:

inputting a frame of the audio signal;

estimating the fundamental frequency of the inputted frame;

transforming the inputted frame from the time domain into the frequency domain to produce a frequency spectrum of the frame;

computing magnitude and phase values for the frequencies in the frequency spectrum of the frame corresponding to each of a prescribed number of integer multiples of the fundamental frequency;

computing a subharmonic-to-harmonic ratio (SHR) for the inputted frame based on the computed magnitude and phase values;

synthesizing a representation of a harmonic component of the inputted frame based on the computed SHR, along with the fundamental frequency and the magnitude and phase values;

computing a non-harmonic component of the inputted frame based on the magnitude and phase values, along with the synthesized harmonic component representation;

computing a harmonic to non-harmonic ratio (HnHR) based on the synthesized harmonic component representation and the non-harmonic component; and designating the computed HnHR as an estimate of the speech quality of the inputted frame in the single-channel audio signal.

3. The process of claim 2, wherein the process action of transforming the inputted frame from the time domain into the frequency domain to produce a frequency spectrum of the frame, comprises employing discrete Fourier transform (DFT).

4. The process of claim 3, wherein the process action of computing the magnitude and phase values, comprises computing the magnitude and phase values for the frequencies in the frequency spectrum of the frame corresponding to each of a prescribed number of integer multiples of the fundamental frequency, wherein the integer values range between values that keep the product of each integer value and the fundamental frequency between a prescribed frequency range.

5. The process of claim 4, wherein the prescribed frequency range is 50-5000 Hertz.

6. The process of claim 2, wherein the process action of computing the subharmonic-to-harmonic ratio (SHR) for the inputted frame based on the computed magnitude and phase values, comprises computing the quotient of a summation of the magnitude values computed for each frequency in the frequency spectrum of the frame corresponding to each of the prescribed number of integer multiples of the fundamental frequency divided by a summation of magnitude values computed for each frequency in the frequency spectrum of the frame corresponding to each of the prescribed number of integer multiples of the fundamental frequency less 0.5.

7. The process of claim 2, wherein the process action of synthesizing the representation of the harmonic component of the inputted frame based on the computed SHR, along with the fundamental frequency and the magnitude and phase values, comprises:

computing an amplitude weighting factor W(l) to gradually decrease the energy of the synthesized representation of the harmonic component signal of the frame at a reverberation tail interval thereof;

synthesizing a time domain harmonic component $\hat{x}_{eh}(l, t)$ of the frame for a series of sample times using the equation, $\hat{x}_{eh}(l, t)=W(l)\Sigma_{k=1}^{K}|X(l,kF_0)|\cos(\angle S(kF_0)+2\pi kF_0 t)$, wherein l is the frame under consideration, t is a sample time value, $F_0$ is the fundamental frequency, k is an integer multiple of the fundamental frequency, K is a maximum integer multiple, and S is the time domain signal corresponding to the frame; and transforming the synthesized time domain harmonic component $\hat{x}_{eh}(l, t)$ for the frame into the frequency domain employing a discrete Fourier transform (DFT) to produce a synthesized frequency domain harmonic component $\hat{X}_{eh}(l, f)$ for the frame l at each frequency f in the frequency spectrum of the frame corresponding to each of the prescribed number of integer multiples of the fundamental frequency.

8. The process of claim 7, wherein the process action of computing the amplitude weighting factor W(l), comprises computing a quotient of the computed SHR to the fourth power divided by the sum of the computed SHR to the fourth power plus a prescribed weighting parameter.

9. The process of claim 7, wherein the process action of computing the non-harmonic component of the inputted frame based on the magnitude and phase values, along with the synthesized harmonic component representation, comprises:

for each frequency in the frequency spectrum of the frame corresponding to an integer multiple of the fundamental frequency, subtracting the synthesized frequency domain harmonic component associated with the frequency from the computed magnitude value of the frame at that frequency to produce a difference value; and using an expectation operator function to compute a non-harmonic component expectation value from the difference values produced.

10. The process of claim 9, wherein the process action of computing the HnHR, comprises:

using an expectation operator function to compute a harmonic component expectation value from the synthesized frequency domain harmonic components associated with the frequencies in the frequency spectrum of the frame corresponding to the integer multiples of the fundamental frequency;

computing a quotient of the computed harmonic component expectation value divided by the computed non-harmonic component expectation value; and designating the quotient as the HnHR.

11. The process of claim 7, wherein the process action of computing the non-harmonic component of the inputted frame based on the magnitude and phase values, along with the synthesized harmonic component representation, comprises:

for each frequency in the frequency spectrum of the frame corresponding to an integer multiple of the fundamental frequency, subtracting the synthesized frequency domain harmonic component associated with the frequency from the computed magnitude value of the frame at that frequency to produce a difference value; and summing the square of each difference value to compute a non-harmonic component value.

12. The process of claim 11, wherein the process action of computing the HnHR, comprises:

summing the square of each synthesized frequency domain harmonic component associated with the frequencies in the frequency spectrum of the frame corresponding to the integer multiples of the fundamental frequency to produce a harmonic component value;

computing a quotient of the harmonic component value divided by the non-harmonic component value; and designating the quotient as the HnHR.

13. The process of claim 7, wherein the process action of computing the HnHR comprises computing a smoothed HnHR which is smoothed using a portion of the HnHR computed for one or more preceding frames of the audio signal.

14. The process of claim 13, wherein the process action of computing the non-harmonic component of the inputted frame based on the magnitude and phase values, along with the synthesized harmonic component representation, comprises:

for each frequency in the frequency spectrum of the frame corresponding to an integer multiple of the fundamental frequency, subtracting the synthesized frequency domain harmonic component associated with the frequency from the computed magnitude value of the frame at that frequency to produce a difference value;

using an expectation operator function to compute a non-harmonic component expectation value from the difference values produced; and adding a prescribed percentage of a smoothed non-harmonic component expectation value computed for the frame of the audio signal immediately preceding the current frame to the non-harmonic component expectation value computed for the current frame to produce a smoothed non-harmonic component expectation value for the current frame.

15. The process of claim 14, wherein the process action of computing the smoothed HnHR, comprises:

using an expectation operator function to compute a harmonic component expectation value from the synthesized frequency domain harmonic components associated with the frequencies in the frequency spectrum of the frame corresponding to the integer multiples of the fundamental frequency;

adding a prescribed percentage of a smoothed harmonic component expectation value computed for the frame of the audio signal immediately preceding the current frame to the harmonic component expectation value computed for the current frame to produce a smoothed harmonic component expectation value for the current frame;

computing a quotient of the smoothed harmonic component expectation value divided by the smoothed non-harmonic component expectation value; and designating the quotient as the smoothed HnHR.

16. The process of claim 13, wherein the process action of computing the non-harmonic component of the inputted frame based on the magnitude and phase values, along with the synthesized harmonic component representation, comprises:

for each frequency in the frequency spectrum of the frame corresponding to an integer multiple of the fundamental frequency, subtracting the synthesized frequency domain harmonic component associated with the frequency from the computed magnitude value of the frame at that frequency to produce a difference value;

summing the square of each difference value to compute a non-harmonic component value; and adding a prescribed percentage of a smoothed non-harmonic component value computed for the frame of the audio signal immediately preceding the current frame to the non-harmonic component value computed for the current frame to produce a smoothed non-harmonic component expectation value for the current frame.

17. The process of claim 16, wherein the process action of computing the smoothed HnHR, comprises:

summing the square of each synthesized frequency domain harmonic component associated with the frequencies in the frequency spectrum of the frame corresponding to the integer multiples of the fundamental frequency to produce a harmonic component value;

adding a prescribed percentage of a smoothed harmonic component value computed for the frame of the audio signal immediately preceding the current frame to the harmonic component value computed for the current frame to produce a smoothed harmonic component value for the current frame;

computing a quotient of the smoothed harmonic component value divided by the smoothed non-harmonic component value; and designating the quotient as the smoothed HnHR.

18. The process of claim 2, further comprising, prior to performing the process action of estimating the fundamental frequency of the inputted frame, performing the process actions of:

employing a voice activity detection (VAD) technique to determine whether the power of the signal associated with the inputted frame is less than a prescribed minimum power threshold; and whenever it is determined the power of the signal associated with the inputted frame is less than a prescribed minimum power threshold, eliminated from further processing.

19. A computer-implemented process for providing feedback to a user of an audio speech capturing system about the quality of speech in a captured single-channel audio signal comprising human speech components, comprising:

using a computer comprising a processing unit and a memory to perform the following process actions:

inputting said captured audio signal;

determining whether the speech quality of said captured audio signal has fallen below a prescribed acceptable level; and providing feedback to the user whenever the speech quality of said captured audio signal has fallen below the prescribed acceptable level.

20. The process of claim 19, wherein the process action of determining whether the speech quality of said captured audio signal has fallen below a prescribed acceptable level, comprises the actions of:

segmenting the inputted signal into audio frames;

for each audio frame in time order starting with the oldest, estimating the fundamental frequency of the frame, transforming the frame from the time domain into the frequency domain to produce a frequency spectrum of the frame, computing magnitude and phase values of the frequencies in the frequency spectrum of the frame corresponding to each of a prescribed number of integer multiples of the fundamental frequency, computing a subharmonic-to-harmonic ratio (SHR) for the frame based on the computed magnitude and phase values, synthesizing a representation of a harmonic component of the frame based on the computed SHR, along with the fundamental frequency and the magnitude and phase values, computing a non-harmonic component of the frame based on the magnitude and phase values, along with the synthesized harmonic component representation, and computing a harmonic to non-harmonic ratio (HnHR) based, on the synthesized harmonic component representation and the non-harmonic component;

deeming that the speech quality of said captured audio signal has fallen below the prescribed acceptable level whenever a prescribed number of consecutive audio frames have a computed HnHR that does not exceed a prescribed speech quality threshold.

* * * * *